US011434552B2

(12) United States Patent
Guesser et al.

(10) Patent No.: US 11,434,552 B2
(45) Date of Patent: Sep. 6, 2022

(54) VERMICULAR CAST IRON ALLOY FOR INTERNAL COMBUSTION ENGINE BLOCK AND HEAD

(71) Applicant: TUPY S.A., Joinville (BR)

(72) Inventors: Wilson Luiz Guesser, Joinville (BR); Carlos De Souza Cabezas, Joinville (BR); Eitan Melleras, Joinville (BR); Vanessa Mais, Joinville (BR); Ailton Luiz Muller, Joinville (BR)

(73) Assignee: Tupy S.A., Joinville (BR)

( * ) Notice: Subject to any disclaimer, the term of this patent is extended or adjusted under 35 U.S.C. 154(b) by 137 days.

(21) Appl. No.: 16/337,028

(22) PCT Filed: Sep. 29, 2017

(86) PCT No.: PCT/BR2017/050295

§ 371 (c)(1),
(2) Date: Mar. 27, 2019

(87) PCT Pub. No.: WO2018/058228

PCT Pub. Date: Apr. 5, 2018

(65) Prior Publication Data

US 2020/0032377 A1 Jan. 30, 2020

(30) Foreign Application Priority Data

Sep. 29, 2016 (BR) ..... 1020160226902

(51) Int. Cl.
*C22C 37/00* (2006.01)
*C22C 33/08* (2006.01)
(Continued)

(52) U.S. Cl.
CPC ..... *C22C 37/00* (2013.01); *C21D 1/06* (2013.01); *C22C 33/08* (2013.01); *C22C 38/00* (2013.01);
(Continued)

(58) Field of Classification Search
CPC ..... C22C 37/00; C22C 33/08; C22C 38/00; C22C 37/04; C22C 37/10; C21D 1/06; C21D 2211/009; F02F 1/00; C21C 1/10
See application file for complete search history.

(56) References Cited

U.S. PATENT DOCUMENTS 4,036,641 A 7/1977 Evans et al.
2003/0007882 A1* 1/2003 Perrin ..... C22C 33/08 420/22

(Continued)

FOREIGN PATENT DOCUMENTS

BR 0105989 11/2002
CN 101423914 A 5/2009

(Continued)

OTHER PUBLICATIONS

CN-103255335-A: Espacenet English Machine translation (Year: 2013).*

*Primary Examiner* — Keith Walker
*Assistant Examiner* — Adil A. Siddiqui
(74) *Attorney, Agent, or Firm* — Harrington & Smith

(57) ABSTRACT

The present invention refers to a vermicular cast iron alloy specially designed for internal combustion engine blocks and heads having special requirements of mechanical strength and fatigue strength. Vermicular iron alloy with high mechanical strength and high fatigue strength for the production of internal combustion engines blocks and heads characterized by having a microstructure of pearlitic matrix and predominantly vermicular graphite (>70%) and presence of graphite nodules in up to 30%, wherein its graphite microstructure is described by the Microstructure Factor (FM), as defined below, with Microstructure Factor values higher than 0.94.

3 Claims, 3 Drawing Sheets

(a)

(b)

(51) Int. Cl.
*C22C 38/00* (2006.01)
*F02F 1/00* (2006.01)
*C21D 1/06* (2006.01)

(52) U.S. Cl.
CPC ..... *F02F 1/00* (2013.01); *C21D 2211/009* (2013.01)

(56) References Cited

U.S. PATENT DOCUMENTS

| | | | | |
|---|---|---|---|---|
| 2014/0255233 | A1* | 9/2014 | Park | B22D 25/06 418/55.2 |
| 2014/0318516 | A1* | 10/2014 | Edmo | C22C 37/04 420/10 |
| 2016/0047008 | A1* | 2/2016 | Margaria | C21D 5/02 75/328 |
| 2017/0211507 | A1* | 7/2017 | Qin | F02F 1/004 |

FOREIGN PATENT DOCUMENTS

| | | | | |
|---|---|---|---|---|
| CN | 101956123 | A | | 1/2011 |
| CN | 103255335 | A | * | 8/2013 |
| ES | 2 052 885 | | | 7/1994 |
| JP | S60247036 | | | 12/1985 |
| WO | WO 00/01860 | | | 1/2000 |

* cited by examiner (a) (b)

VERMICULAR CAST IRON ALLOY FOR INTERNAL COMBUSTION ENGINE BLOCK AND HEAD

CROSS REFERENCE TO RELATED APPLICATION

This patent application is a U.S. National Stage application of International Patent Application Number PCT/BR2017/050295 filed Sep. 29, 2017, which is hereby incorporated by reference in its entirety, and claims priority to BR 1020160226902 filed Sep. 29, 2016.

FIELD OF THE INVENTION

The present invention refers to a vermicular cast iron alloy specially designed for internal combustion engine blocks and heads having special requirements of mechanical strength and fatigue strength.

BACKGROUND OF THE INVENTION

The demand for cast alloys with high mechanical strength has been intense in the automotive industry, aiming at reducing vehicle weight and increasing engine power. The arrival of vermicular iron, in the CGI 400 and CGI 450 grades, brought new opportunities for designers, both for blocks and for heads, in engines of different sizes, but all with high power density. These vermicular cast irons have much better mechanical strength than gray cast irons, reaching up to 450 MPa of Strength Limit and 315 MPa of Yield Stress 0.2, wherein the Fatigue Limit may be higher than 160 MPa, in tension-compression stresses with average tension equal to zero. In addition, its thermal conductivity is good, intermediate between nodular irons and gray irons, allowing good thermal extraction in parts exposed to high temperatures.

Technical standard ISO 16112/200 foresees a class of up to 500 MPa of Strength Limit, but this has not translated into any suitable industrial manufacturing technique to serve this class. In addition, the hardness of this class would be, according to the standard ISO, up to 260 HB. The standard ASTM A 842, because it limits the nodularity of the vermicular irons by 20%, it does not predict said class of Strength Limit of 500 MPa, since it will require a greater nodularity. In the standard SAE J1887 the class 500 is expected, however having nodularity up to 50% and a hardness of up to 269 HB, which should sensibly reduce the thermal conductivity and represent special difficulties of presence of shrinkage and machining. Strictly speaking, said class fits only to parts of very simple geometry, such as cylinder liners and rings. Also, the vermicular iron described in the patent CN 101423914, even with pearlitic matrix, is applicable only to parts of very simple geometry, such as rings, because they contain high levels of phosphorus, which increases the tendency to the presence of casting defects in complex parts, thus making it impossible to obtain high values of mechanical strength, in particular fatigue strength. Another patent even older, of 1977, U.S. Pat. No. 4,036,641, describes a process of manufacturing vermicular iron using iron-silicon-magnesium-rare earth-titanium alloy, resulting in a vermicular iron with high titanium contents, up to 0.15%, also not suitable for complex parts such as engine blocks and heads, due to the tendency to form internal porosities, not allowing the achievement of high values of mechanical strength.

Thus, the increase of the use of vermicular irons in blocks and heads, parts of complex geometry, demands a new class of this material, with a minimum Strength Limit of 500 MPa and hardness values not exceeding 260 HB.

OBJECTIVES OF THE INVENTION

In this regard it is presented the present invention of a vermicular cast iron alloy with special requirements of mechanical strength and fatigue strength.

SUMMARY OF THE INVENTION

It is presented a vermicular iron alloy with high mechanical strength and high fatigue strength for the production of internal combustion engines blocks and heads having a microstructure of pearlitic matrix and predominantly vermicular graphite (>70%) and presence of graphite nodules in up to 30%, wherein its graphite microstructure is described by the Microstructure Factor (FM), as defined below, with Microstructure Factor values higher than 0.94, wherein $FM=(8.70\times A1-0.541\times A2+0.449\times A3+0.064\times A4)/1000$, (A1—percentage of nodulization, referring to the number of spherical particles of graphite, considering particles smaller than 10 μm, A2—number of graphite particles greater than 10 μm, per $mm^2$, A3—number of graphite particles smaller than 10 μm, per $mm^2$, and A4—number of eutectic cells, per $cm^2$. The vermicular iron alloy with high mechanical strength for the production of internal combustion engines blocks and heads presents a minimum Strength Limit of 500 MPa, a minimum Yield Stress of 350 MPa, a minimum Fatigue Limit of 190 MPa (tension-compression, R=−1).

It is presented an internal combustion engine block which presents, in samples obtained from the support bearings, a minimum Strength Limit of 500 MPa, a minimum Yield Stress of 350 MPa, a minimum Fatigue Limit of 190 MPa (tension-compression, R=−1).

It is presented an internal combustion engine head which presents, in samples obtained from the combustion face, a minimum Strength Limit of 500 MPa, a minimum Yield Stress of 350 MPa, a minimum Fatigue Limit of 190 MPa (tension-compression, R=−1).

BRIEF DESCRIPTION OF THE DRAWINGS

The present patent of invention will be described in detail on the basis of the figures listed below, which.

DETAILED DESCRIPTION OF THE INVENTION

Figure 1:
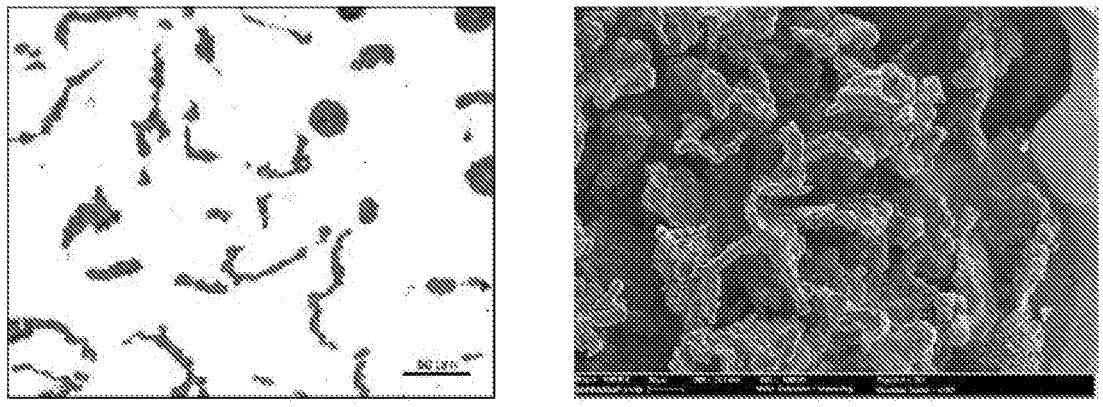
FIG. 1 shows micrographs of the vermicular iron, object of the present invention in which: (a)—Optical microscopy, 200× magnification, without attack; (b)—Scanning electron microscopy, with deep attack, 1,000× magnification.
Figure 2:
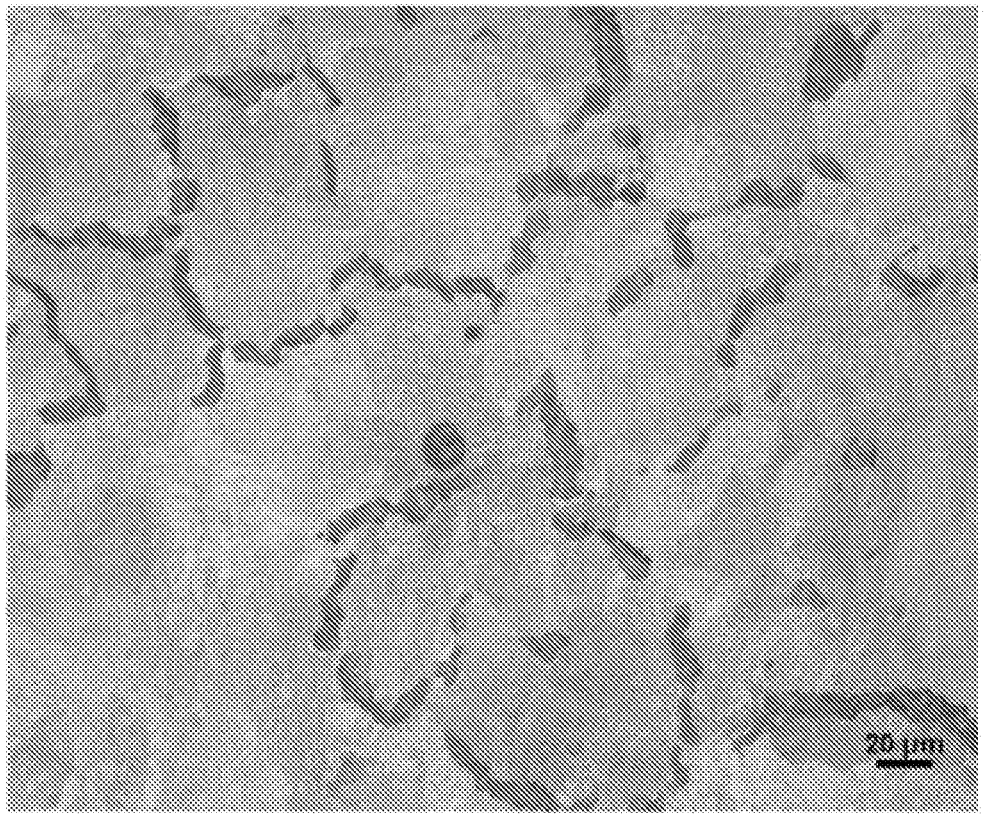
FIG. 2 shows microstructure of the vermicular iron, object of the present invention (Nital attack and 400× magnification)

The present invention provides a novel vermicular cast iron alloy with a microstructure that allows obtaining high levels of mechanical properties obtained from as cast material, in particular fatigue strength. This microstructure can be seen in FIGS. 1 and 2, consisting of a pearlitic matrix and a predominantly vermicular graphite structure (form III of the standard ISO 945/1975), with a minimum of 70% vermicular graphite, and the presence of graphite nodules (form VI of the standard ISO 945/1975), by up to 30%. The main microstructural difference of this new type of vermicular iron, compared to the vermicular irons of the CGI 400 and CGI 450 grades, is described in the Microstructure Factor (FM), defined as:

$$FM=(8.70\times A1-0.541\times A2+0.449\times A3+0.064\times A4)/1000,$$

wherein: A1—percentage of nodulization, referring to the number of spherical particles of graphite, considering particles smaller than 10 μm; A2—number of graphite particles greater than 10 μm, per $mm^2$; A3—number of graphite particles smaller than 10 μm, per $mm^2$; and A4—number of eutectic cells, per $cm^2$.

The vermicular irons of CGI 400 and CGI 450 grades present Microstructure Factor values between 0 and 0.93, while the vermicular iron of the present invention shows Microstructure Factor of greater than 0.94. This microstructure difference is obtained by treatments of the liquid bath, prior to the casting of the metal in the mold, and involving the combined addition of balanced proportions of Mg (from 0.010 to 0.070%), Rare Earths (from 0.005 to 0.050%), and of Si-rich inoculant (from 0.005 to 0.150%). The chemical composition of vermicular iron is characteristic of this material, without special alloying elements, and contains carbon (3.0-3.9%), manganese (0.1-0.6%), silicon (1.5-3.0%), magnesium (0.005-0.030%), cerium (0.005-0.030%), tin (0.04-0.12%), copper (0.2-1.2%), sulfur residual (less than 0.030%), phosphorus residual (less than 0.050%) and titanium residual (less than 0.020%), all these percentages by weight. Other common impurities in the cast irons may further be present.

The microstructure thus obtained, with the Microstructure Factor of greater than 0.94, allows obtaining a minimum Strength Limit of 500 MPa, a minimum Yield Stress of 350 MPa, and a minimum Fatigue Limit of 190 MPa, in a tension-compression test with 107 cycles, with R=−1. The hardness is in values up to 255 HB.

Specifically, said vermicular iron alloy is characterized by the fact that it presents a microstructure which results in high values of mechanical properties. The mechanical properties are characterized by a minimum Strength Limit of 500 MPa, a minimum Yield Stress of 350 MPa, and a minimum Fatigue Limit of 190 MPa, in a tension-compression test with 107 cycles. This set of properties is obtained with a pearlitic matrix, and with graphite morphology and distribution described by the Microstructure Factor, as described in the text.

This Microstructure Factor should assume a minimum value of 0.94, with predominance of vermicular graphite (>70%) and presence of nodular graphite in up to 30%.

With this set of properties it is then possible to design new engine blocks and heads in order to reduce the weight of the components and increase the engine power.

Figure 3:
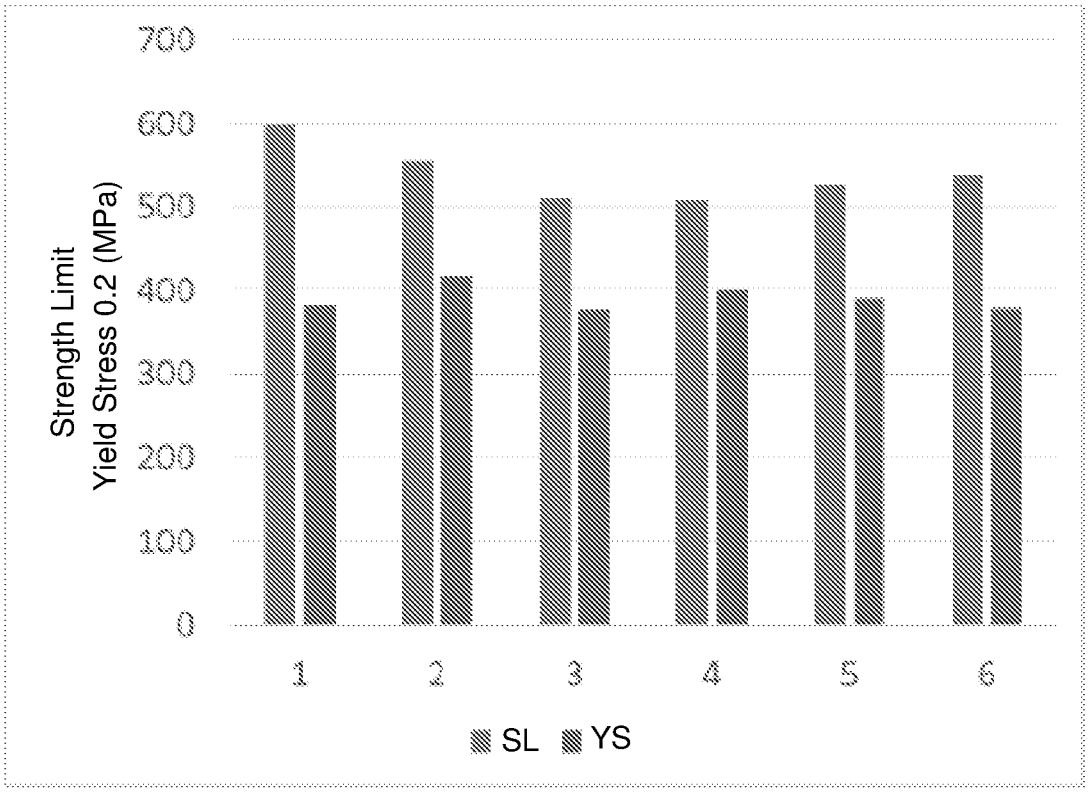
FIG. 3 shows Results of Tensile Strength Limit and Yield Stress for the vermicular iron, object of the present invention. Samples obtained from bearing of V6 engine block. Average Strength Limit of sampling=540 MPa. Average Yield Stress of sampling=390 MPa.

FIG. 3 shows a set of results of tensile tests of vermicular cast iron, object of the present invention. It is verified that this vermicular iron presents a Strength Limit of more than 500 MPa, and a Yield Stress of more than 350 MPa, in samples obtained from part, in the case from support bearing of V6 engine block. This sample provided a Fatigue Limit, in the tension-compression test with R=−1, by the staircase method, with a value of 193 MPa.

Thus, the present invention of vermicular irons with high mechanical strength, in particular high fatigue strength, allows the development of high performance engine blocks and heads suitable for high power density engines involving high levels of mechanical stress.

The invention claimed is:

1. A vermicular iron alloy with high mechanical strength and high fatigue strength for the production of internal combustion engine blocks and heads having a microstructure of pearlitic matrix and predominantly vermicular graphite (>70%) and presence of graphite nodules in up to 30%, wherein the vermicular iron alloy's graphite microstructure is described by the Microstructure Factor (FM), as defined below, with Microstructure Factor values higher than 0.94;

$$FM=(8.70\times A1-0.541\times A2+0.449\times A3+0.064\times A4)/1000,$$

where:

A1—percentage of nodulization, referring to the number of spherical particles of graphite divided by particles smaller than 10 μm;

A2—number of graphite particles greater than 10 μm, per $mm^2$;

A3—number of graphite particles smaller than 10 μm, per $mm^2$; and

A4—number of eutectic cells, per $cm^2$;

wherein a chemical composition of the vermicular iron alloy consists of:

carbon (3.0-3.9% by weight), manganese (0.1-0.6% by weight), silicon (1.5-3.0% by weight), magnesium (0.005-0.030% by weight), cerium (0.005-0.030% by weight), tin (0.04-0.12% by weight), copper (0.2-1.2% by weight), sulfur residual (less than 0.030% by weight), phosphorus residual (less than 0.050% by weight), and titanium residual (less than 0.020% by weight), including iron and common impurities as being the balance of the alloy; and said vermicular iron alloy having a minimum Strength Limit of 500 MPa, a minimum Yield Stress of 350 MPa, a minimum Fatigue Limit of 190 MPa measured by a tension-compression test, with $10^7$ cycles, with stress ratio (R=−1), and a hardness in values up to 255 HB.

2. An internal combustion engine block, produced with the vermicular iron alloy as defined in claim 1, having, in samples obtained from the support bearings, a minimum Tensile Strength of 500 MPa, a minimum Yield Stress of 350 MPa, and a minimum Fatigue Limit of 190 MPa measured by a tension-compression test, with stress ratio (R=−1).

3. An internal combustion engine head, produced with the vermicular iron alloy as defined in claim 1, having, in samples obtained from the combustion face, a minimum Tensile Strength of 500 MPa, a minimum Yield Stress of 350 MPa, and a minimum Fatigue Limit of 190 MPa measured by a tension-compression test, with stress ratio (R=−1).

* * * * *